US009305757B2

(12) United States Patent
Baba

(10) Patent No.: US 9,305,757 B2
(45) Date of Patent: Apr. 5, 2016

(54) ION EXTRACTION METHOD FOR ION TRAP MASS SPECTROMETRY

(71) Applicant: DH Technologies Development Pte. Ltd., Singapore (SG)

(72) Inventor: Takashi Baba, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 24 days.

(21) Appl. No.: 14/369,344

(22) PCT Filed: Dec. 6, 2012

(86) PCT No.: PCT/IB2012/002621

§ 371 (c)(1),
(2) Date: Jun. 27, 2014

(87) PCT Pub. No.: WO2013/098614

PCT Pub. Date: Jul. 4, 2013

(65) Prior Publication Data

US 2014/0374592 A1 Dec. 25, 2014

Related U.S. Application Data

(60) Provisional application No. 61/581,278, filed on Dec. 29, 2011.

(51) Int. Cl.

| | |
|---|---|
| ***H01J 49/42*** | (2006.01) |
| ***H01J 49/26*** | (2006.01) |
| ***H01J 49/06*** | (2006.01) |

(52) U.S. Cl.

CPC ..... *H01J 49/06* (2013.01); *H01J 49/26* (2013.01); *H01J 49/4225* (2013.01); *H01J 49/4255* (2013.01)

(58) Field of Classification Search

CPC . H01J 49/4225; H01J 49/004; H01J 49/4265; H01J 49/4285; H01J 49/427

USPC ..... 250/282, 292, 283, 281, 288

See application file for complete search history.

(56) References Cited

U.S. PATENT DOCUMENTS

| | | | | |
|---|---|---|---|---|
| 6,329,654 | B1 | 12/2001 | Gulcicek et al. | |
| 8,766,170 | B2 * | 7/2014 | Guna et al. | 250/282 |
| 2003/0222210 | A1 | 12/2003 | Stott et al. | |
| 2004/0011956 | A1 | 1/2004 | Londry et al. | |
| 2004/0238734 | A1 * | 12/2004 | Hager et al. | 250/281 |
| 2009/0072132 | A1 * | 3/2009 | Manri et al. | 250/282 |
| 2009/0294661 | A1 | 12/2009 | Hashimoto et al. | |
| 2015/0041639 | A1 * | 2/2015 | Guna | 250/283 |

OTHER PUBLICATIONS

International Search Report from International Patent Application No. PCT/IB2012/002621, dated May 16, 2013.

* cited by examiner

*Primary Examiner* — Nikita Wells

(57) ABSTRACT

A method is provided for processing ions in a multipole ion trap, comprising generating RF radial confinement fields within a first and second multipole rod set positioned in tandem, a ratio of q value exhibited by the second rod set relative to the first rod set being greater than one for any m/z, said RF axial confinement fields within the first and second rod sets interacting in an interaction region between the first and second rod sets so as to produce a fringing field; transmitting ions through said first rod set towards said second rod set; and increasing the radial oscillation amplitude of at least a portion of the ions within said first rod set such that at least a portion of said ions having an increased radial oscillation amplitude are repulsed by said fringing field.

20 Claims, 8 Drawing Sheets

Rejection / transmission
m/z=338
IQ2 scan / RFF ON
20110520\agilent012
IQ2 scan / RFF OFF
20110520\agilent013 hitting IQ2
BC=0, no IQ2 barrier
hitting IQ2
This transmission limits is given by small hole diameter on IQ2

ION EXTRACTION METHOD FOR ION TRAP MASS SPECTROMETRY

RELATED APPLICATION

This application claims priority to U.S. provisional application Ser. No. 61/581,278, filed Dec. 29, 2011, which is incorporated herein by reference in its entirety.

FIELD

The invention relates to mass spectrometry, and more particularly to methods and apparatus for the separation of ions in a linear radio-frequency multipole ion trap.

INTRODUCTION

Mass spectrometry (MS) is an analytical technique for determining the elemental composition of test substances that has both quantitative and qualitative applications. For example, MS can be useful for identifying unknown compounds, determining the isotopic composition of elements in a molecule, and determining the structure of a particular compound by observing its fragmentation, as well as for quantifying the amount of a particular compound in the sample.

In mass spectrometry, an ion source typically generates ions from a sample for downstream processing by one or more mass analyzers. Many of the ions generated by conventional ion sources, however, are of little or no analytical utility. Indeed, the presence of such impurity ions often serves to increase the overall charge density within an ion trap at the expense of optimum performance. Accordingly, the ability of a mass spectrometer system to isolate specific ion species is an important feature in mass spectrometry.

Though many unwanted impurity ions can be eliminated by various isolation techniques known in the art (e.g., quadrupole filters operating in RF/DC mass-resolving mode, or in linear ion traps, which can radially eject unwanted species or mass selectively axially eject selected target ions), previous isolation techniques are often incapable of resolving a target ion from substantially isobaric ions having molecular weights that differ from the target ion by less than 1 amu. Further, the mass resolution of such techniques can be impacted by the effect of space charge, which can distort the harmonic RF fields and change the oscillation frequency of resonantly excited ions.

Accordingly, there remains a need for mass spectrometer systems and methods having improved mass selectivity.

SUMMARY

In accordance with one aspect, certain embodiments of the applicant's teachings relate to a method for processing ions in a linear radio-frequency multipole ion trap. According to the method, a first multipole rod set can be positioned in tandem with a second multipole rod set, each rod set having a first end and a second end. The method can comprise introducing ions into the first and second rod sets through the first end of said first rod set. RF fields can be generated within the first and second rod sets so as to radially confine the ions, the RF fields interacting in an interaction region between the second end of the first rod set and the first end of the second rod set to produce a fringing field. The method can also comprise generating a barrier field at the second end of said second rod set so as to repel at least a portion of said ions away from the second end of the second rod set and toward the first rod set.

The repelled ions can be energized within the second rod set so that at least a portion of the energized ions are repulsed by the fringing field back toward the second end of the second rod set.

In accordance with an aspect of various embodiments of the applicant's teachings, at least a portion of the repelled ions can be ejected into said first rod set. In some aspects, at least a portion of the energized ions can be ejected into said first rod set. In some aspects, energizing the repelled ions can comprise applying an auxiliary excitation signal to the second rod set so as to resonantly excite ions having a selected m/z. In various embodiments, the auxiliary excitation signal can comprise an auxiliary AC waveform having a frequency that substantially matches a secular frequency of the ions having the selected m/z. In some aspects, the auxiliary AC waveform generates a dipolar excitation field. In various embodiments, the RF field within the second rod set can interact with the barrier field in an extraction region adjacent to the second end of the second rod set to produce a second fringing field, wherein the auxiliary AC waveform selectively ejects at least a portion of the ions having the selected m/z from the second end of the second rod set. By way of example, the barrier field can be a DC field.

In accordance with an aspect of various embodiments of the applicant's teachings, ions having a selected m/z are repulsed by the fringing field. In some embodiments, generating the RF fields within the first and second rod sets can comprise applying an identical RF waveform to each of the first and second rod sets. In various aspects, the first and second rod sets can be axially aligned along a central axis. In some embodiments, a distance between the central axis and rods of the first rod set is less than a distance between the central axis and rods of the second rod set.

In accordance with an aspect of various embodiments of the applicant's teachings, generating the RF fields within the first and second rod sets can comprise applying a first RF waveform to the first rod set and a second RF waveform to the second set, wherein the first and second RF waveforms are different. In some aspects, the first RF waveform has a larger amplitude than the second RF waveform. In various embodiments, the first RF waveform can have a smaller frequency than the second RF waveform.

In accordance with an aspect of various embodiments of the applicants' teachings, for an ion having a selected m/z, a q value for the first rod set can be greater than a q value for the second rod set. In some aspects, a ratio of the q value of the first rod set to the q value of the second rod set can be in a range of from about 1.1 to about 1.3.

In accordance with an aspect of various embodiments of the applicant's teachings, a DC potential between the first and second rod sets can be generated. In various aspects, the method can comprise adjusting the DC potential to modulate the fringing field.

In various aspects, the first and second multipole rod sets can comprise quadrupole rod sets.

In accordance with one aspect, certain embodiments of the applicant's teachings relate to a method for processing ions in a linear ion trap. According to the method, a first multipole rod set can be positioned in tandem with a second multipole rod set, a ratio of q value exhibited by the second rod set relative to the first rod set being greater than one. RF radial confinement fields can be generated within the first and second rod sets, the RF axial confinement fields interacting in an interaction region between the first and second rod sets so as to produce a fringing field. The method can also comprise transmitting ions through the first rod set towards said second rod set and increasing the radial oscillation amplitude of at least a portion of the ions within the first rod set such that at least a portion of the excited ions are repulsed by the fringing field.

In various aspects, at least a portion of ions transmitted through the first rod set can be axially ejected into the second rod set during the excitation of said excited ions. In some aspects, the ratio of q value is in a range of about 1.1 to about 1.3. In some aspects, increasing the radial oscillation amplitude can comprise resonantly exciting at least a portion of the ions within the first rod set (e.g., via applying an auxiliary excitation signal to the first rod set). In various aspects, the auxiliary excitation signal can comprise an auxiliary AC waveform having a frequency that substantially matches a secular frequency of ions having a selected m/z.

In accordance with one aspect, certain embodiments of the applicant's teachings relate to a mass spectrometer system. The system can comprise an ion source and a first multipole rod set extending between a first end for admitting ions from the ion source and a second end. The second multipole rod set can extend between a first end and a second end, a ratio of q value exhibited by the first rod set relative to the second rod set being greater than one for any m/z. The system can also comprise a controller coupled to the first and second rod sets and configured to (i) apply an RF waveform to at least one of the first and second rod sets so as to produce an RF axial confinement field in each of the first and second rod sets, wherein the RF axial confinement fields interact in an interaction region between the first and second rod sets to produce a fringing field, (ii) generate a barrier field at the second end of the second rod set, (iii) generate a DC potential between the first and second rod sets, and (iv) apply an auxiliary AC waveform to the second rod set, whereby the auxiliary AC waveform energizes ions repelled from the barrier field so that at least a portion of the energized ions are repulsed by the fringing field back toward the second end of the second rod set. The system can also comprise a detector for detecting ions ejected from the second end of the second rod set.

In various aspects, at least a portion of the repelled ions can be ejected into the first rod set. In some aspects, at least a portion of said energized ions are ejected into said first rod set. In some embodiments, the auxiliary excitation signal can comprise an auxiliary AC waveform having a frequency that substantially matches a secular frequency of ions having a selected m/z. By way of example, the auxiliary AC waveform can generate a dipolar excitation field. In some aspects, the RF axial confinement field within the second rod set can interact with the barrier field in an extraction region adjacent to the second end of the second rod set so as to produce a second fringing field, wherein the auxiliary AC waveform is configured to selectively eject at least a portion of the ions having the selected m/z from the second end of the second rod set. In various embodiments, ions having the selected m/z can be repulsed by the fringing field.

In some aspects, the controller can be configured to apply an identical RF waveform to each of the first and second rod sets so as to produce an RF axial confinement field in each of the first and second rod sets. In various embodiments, the first and second rod sets can be axially aligned along a central axis. In some aspects, the distance between the central axis and rods of the first rod set can be less than a distance between the central axis and rods of the second rod set.

In accordance with one aspect of various embodiments of the applicant's teachings, the controller can be configured to apply a first RF waveform to the first rod set to produce an RF axial confinement field in the first rod set and a different second RF waveform to the second rod set. In various aspects, the first RF waveform can have a larger amplitude than the second RF waveform. In some embodiments, the first RF waveform can have a smaller frequency than the second RF waveform. In some aspects, the controller can be configured to adjust said DC potential so as to modulate the fringing field.

In various embodiments, for an ion having a selected m/z, a q value for the first rod set can be greater than a q value for the second rod set. In some aspects, a ratio of the q value of the first rod set to the q value of the second rod set can be in a range of from about 1.1 to about 1.3.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DETAILED DESCRIPTION

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to slight alteration or variation according to common general knowledge without departing from the scope of the disclosure. The following detailed description of embodiments is not to be regarded as limiting the scope of the applicant's teachings in any manner.

Methods and systems for processing ions in a multipole ion trap are provided herein. In accordance with various aspects of the applicant's teachings, the methods and systems can enable the continuous isolation and/or excitation of target ions and the simultaneous ejection of unwanted impurity ions. In various aspects, methods and systems in accord with applicant's teachings can enable improved mass selectivity.

Figure 1:
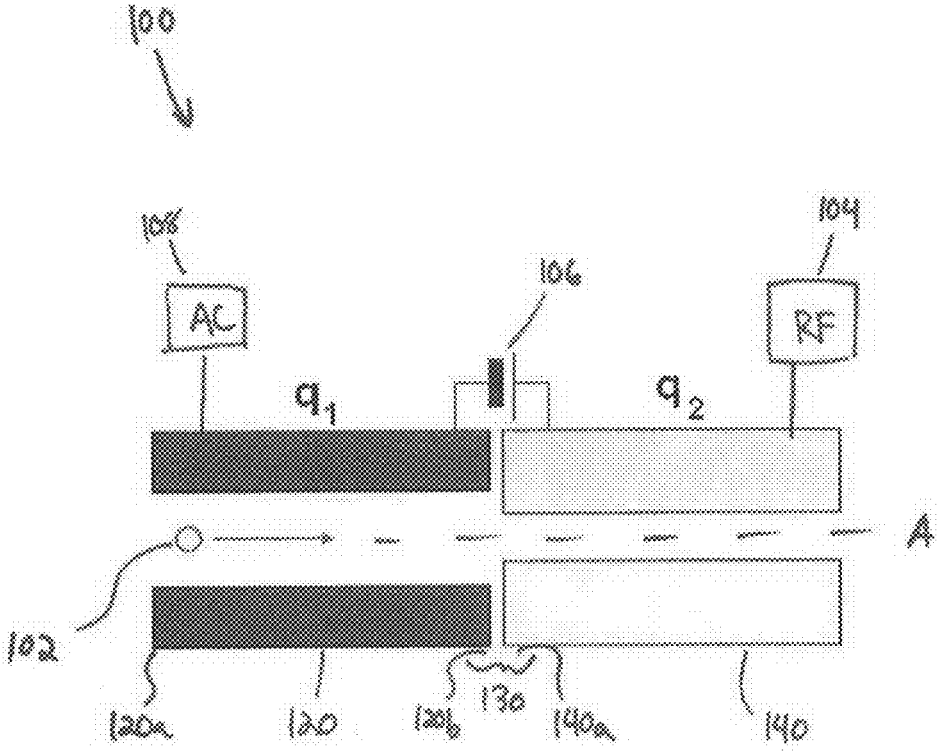
FIG. 1, in schematic diagram, depicts an ion extraction system having two multipole rod sets positioned in tandem in accordance with one aspect of various embodiments of the applicant's teachings.

With reference now to FIG. 1, an exemplary ion extraction device 100 in accordance with various aspects of applicant's teachings is illustrated schematically. The ion extraction system 100 represents only one possible configuration for use in accordance with various aspects of the systems, devices, and methods described herein. As shown in FIG. 1, the ion extraction system 100 can include two quadrupole rod sets 120, 140 that are positioned in tandem and axially aligned along a central axis (A). Though the rod sets 120, 140 are generally referred to herein as quadrupoles (that is, they have four rods), a person skilled in the art will appreciate that methods and devices in accord with applicant's teachings can utilize rod sets having any other suitable multipole configurations, for example, hexapoles, octapoles, etc. It should also be understood that the present teachings are not limited to the use of identical first and second rod sets. That is, one rod set can be one type of a multipole rod set (e.g., quadrupole) and the other rod set can be a different type of a multipole rod set (e.g., hexapole). As shown in FIG. 1, a plurality of ions 102 can be introduced into the first end 120*a* of the rod set 120 and be transmitted towards the rod set 140. One of skill in the art that various upstream components, for example, can be configured to control the movement and/or energy of the ions 102 as they enter into the rod set 120.

One or more RF voltage source(s) 104 can be configured to apply an RF potential to the rods of each of the rod sets 120, 140 to radially trap the ions 102 within the rod sets 120, 140 in a manner known in the art. In various embodiments, the rod sets 120, 140 can be capacitively coupled such that the application of an RF potential of one of the rod sets can be effective to additionally generate a radial trapping potential within the other rod set. Alternatively, in various embodiments, a separate RF source can be employed for each of the rod sets 120,140 such that each of the rod sets can receive a distinct RF waveform from its dedicated RF source. In various embodiments, the RF waveforms applied to the first and second rod sets can have the same frequency and differ in amplitude.

In various embodiments, the RF fields that are generated within the rod sets 120, 140 can differ relative to one another. Because of the proximity of the tandem rod sets 120, 140, the varying RF fields generated by the rod sets 120,140 can interact in an interaction region 130 adjacent to the second end 120*b* of the first rod set 120 and the first end 140*a* of the second rod set 140 to produce fields that are not entirely quadrupolar due to the mutual disturbance in the respective RF fields. Such fields generated by this interaction, commonly referred to as fringing fields, can couple the axial and radial components of an ion's motion. As will be discussed in detail below, the fringing field generated between the rod sets 120, 140 can be utilized, in accord with various aspects of applicant's teachings, to allow ions having a small radial oscillation amplitude to be axially ejected from rod set 120 into rod set 140 while repulsing (e.g., trapping) ions having a large radial oscillation amplitude within the rod set 120, thus providing a barrier field dependent on the radial oscillation amplitude of ions in the first rod set near the fringing field.

As will be appreciated by a person skilled in the art, different RF fields can be generated within the rod sets 120, 140 in a variety of manners. By way of example, the RF waveforms applied to each of the rod sets 120, 140 can vary in amplitude or frequency relative to one another. In addition or in the alternative, the physical geometry of the rod sets 120, 140 can differ relative to one another. In various aspects, the different RF fields can be characterized by a different q value for each of the rod sets 120, 140.

As will be appreciated by a person skilled in the art, when an RF radial trapping potential is applied to a quadrupole rod set, the Mathieu stability parameter q can be defined as follows:

$$q = k\frac{ZeVrf}{mr_0^2\Omega^2} \qquad \text{Eq. (1)}$$

where, $V_{rf}$ denotes the RF voltage applied to the rods, $\Omega$ denotes the angular frequency of the RF voltage, m denotes mass of the ion, Ze denotes the ion charge, $2r_0$ is the distance between the rod and the central axis, and k is constant that depends on definition of $V_{rf}$ in a manner known in the art.

Accordingly, in the ion extraction system 100 depicted in FIG. 1, the different RF fields within the rod sets 120, 140 can be characterized by a ratio of the q value in the rod set 120 ($q_{120}$) relative to the q value in the rod set 140 ($q_{140}$), for any given m/z and angular frequency, as follows:

$$\frac{q_{120}}{q_{140}} = \frac{k_{120}V_{rf120}r_{0,140}^2}{k_{140}V_{rf140}r_{0,120}^2} \qquad \text{Eq. (2)}$$

In accord with various aspects of the applicant's teachings, the rod sets 120, 140 can exhibit a non-unitary ratio of $q_{120}$ to $q_{140}$. By way of example, the ratio of $q_{120}$ to $q_{140}$ can be less than one (i.e., the rod set 120 can have a smaller q value than the rod set 140). Moreover, inspection of Equation 2 indicates that a non-unitary ratio of $q_{120}$ to $q_{140}$ can be obtained in various manners. As discussed above, for example, the amplitude of the RF waveform applied to the rod set 120 ($V_{rf120}$) can be less than the amplitude of the RF waveform applied to the rod set 140 ($V_{rf140}$), all other parameters being equal, such that the ratio of $q_{120}$ to $q_{140}$ is less than 1. Likewise, the distance between the rods of each rod set (e.g., $r_{0,120}$) can differ, all other parameters being equal, so as to alter the ratio of $q_{120}$ to $q_{140}$. Moreover, one of skill in the art will appreciate that both the amplitude of the RF waveforms applied to the rod sets and the distance between the rods of each rod set can differ in order to alter the ratio of $q_{120}$ to $q_{140}$.

In an exemplary embodiment, as depicted in FIG. 1, the q value of the rod set 140 can be increased relative to that of the rod set 120, all other parameters being held equal, by decreasing the distance between the rods in the rod set 140. That is, though an identical RF waveform can be applied to both rod sets 120, 140, the decreased distance between the rods of the rod set 140 from the central axis (A) relative to that of the rod set 120 can result in $q_{140}$ being larger than $q_{120}$.

Additionally, the ion extraction system 100 can be configured to energize ions within the rod set 120 so as to increase the radial oscillation amplitude of at least a portion of the ions within the rod set 120. As will be appreciated by a person skilled in the art, the ions can be energized using a variety of mechanisms including through the application of an auxiliary excitation signal, via ion-molecular reactions (e.g., ion dissociation), and ion-ion reactions. In various embodiments, for example, the ion extraction system can include an auxiliary AC source 108 to generate an auxiliary AC field within the rod set 120. As will be appreciated by a person skilled in the art, the frequency of the auxiliary AC signal can be selected so as to resonantly excite ions of a selected m/z. By way of example, the auxiliary AC signal can have a frequency that substantially corresponds to the secular frequency ($\omega_0$) of a selected ion, where $\omega_0=\beta\Omega/2$, $\Omega$ being the angular frequency of the RF drive and $\beta$ being a function of the Mathieu stability parameters a and q, as is known in the art. Accordingly, the auxiliary AC field can preferentially excite ions of a selected m/z, thereby increasing their radial oscillation amplitude within the rod set 120 relative to ions not having the selected m/z. As will be appreciated by a person skilled in the art, the ions not having the selected m/z can remain relatively radially confined about the central axis of the rod set 120 relative to ions of the selected m/z.

As shown in FIG. 1, the ion extraction system 100 can additionally include a DC power source 106 to apply a DC potential between the rod sets 120, 140 to generate a DC barrier that can modulate the passage of ions between the rod sets 120, 140, as discussed in detail below. By way of example, the DC source 106 can apply a DC potential across the two rod sets 120, 140, or alternatively, in some embodiments, one or more DC sources can maintain the rod set 120 at one DC voltage and the rod set 140 at a different DC voltage.

Figure 2A:
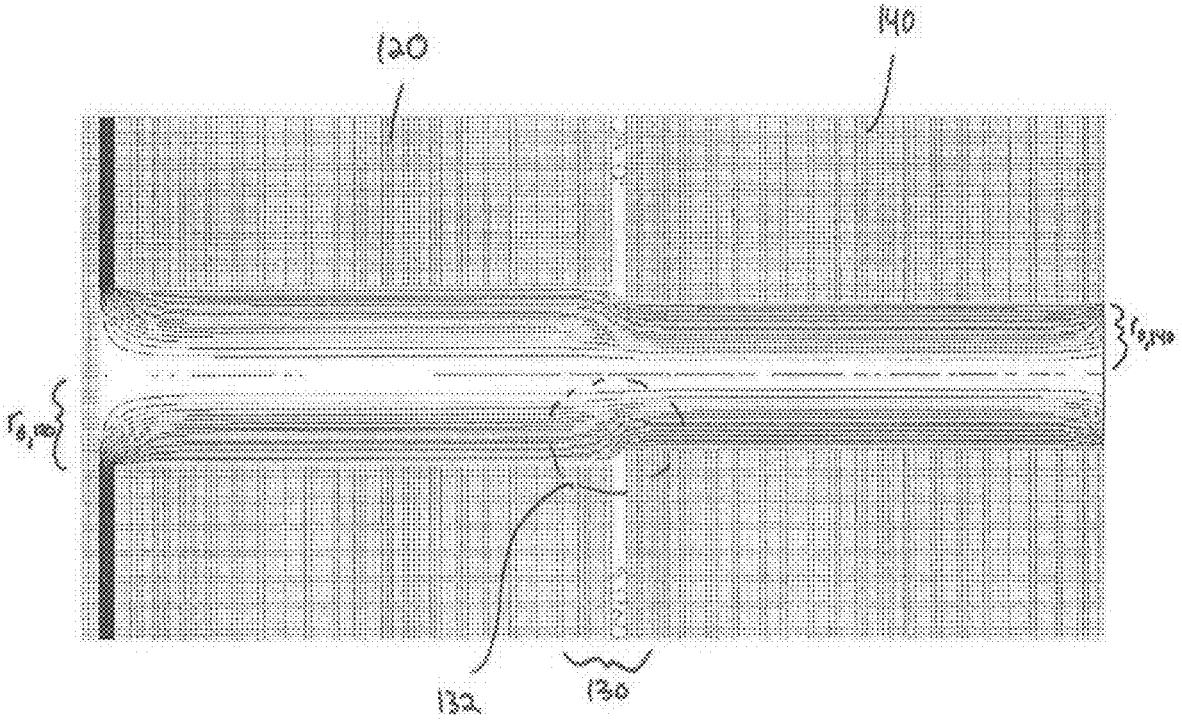
FIG. 2A depicts a simulation demonstrating a reversed fringing field generated in the ion extraction system of FIG. 1.
Figure 2B:
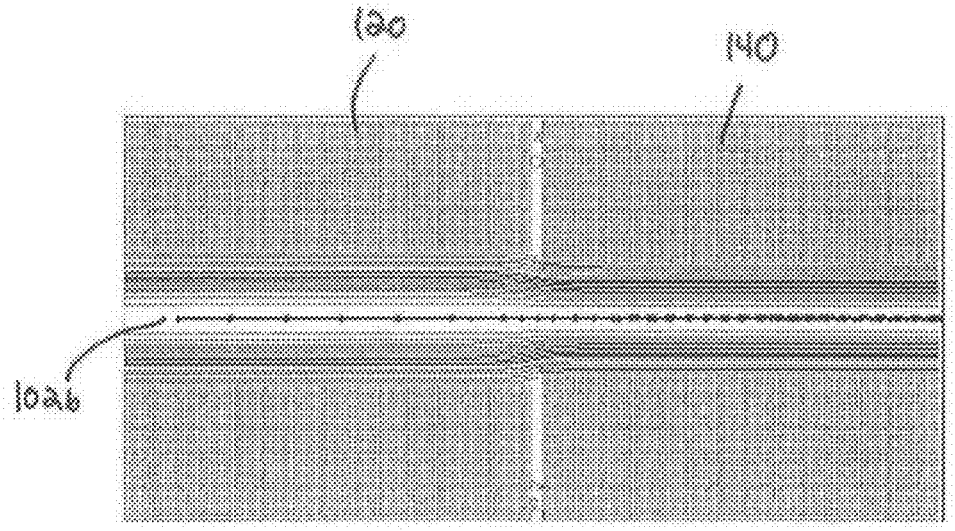
FIG. 2B depicts a simulated path of an ion having an initial radial displacement of 0.2 mm in the ion extraction system of FIG. 1.
Figure 2C:
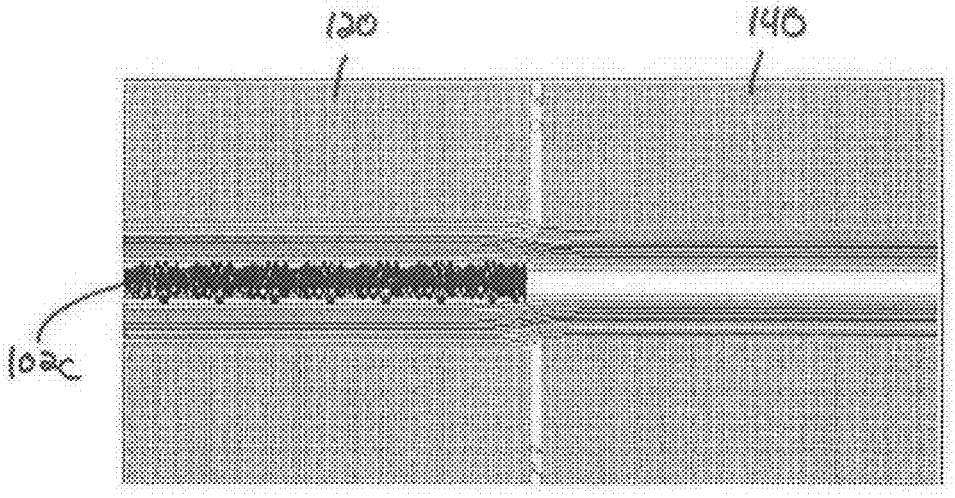
FIG. 2C depicts a simulated path of an ion having an initial radial displacement of 0.2 mm in the ion extraction system of FIG. 1.

With reference now to FIGS. 2A-2C, a theoretical simulation of the trapping and extraction of various ions using the exemplary ion extraction system 100 is depicted, using the following exemplary parameters for the rod sets 120, 140 of FIG. 1 positioned in tandem. The rods of the rod set 120 were spaced 6.8 mm from the central axis ($r_{0,120}$=6.8 mm) and the rods of the rod set 140 were spaced 5.4 mm from the central axis ($r_{0,140}$=5.4 mm). An identical RF waveform was applied to the rod sets 120, 140, with $V_{rf}$=1200 V, $\Omega/2\pi$=1 MHz, and the start of the RF phase at 90 degrees. The q value of the rod set 120 was $q_{120}$=0.65 and the q value of the second rod set was $q_{140}$=0.85 ($q_{120}$:$q_{140}$≈0.76). The rod sets 120,140 were maintained at 0V DC. No auxiliary AC waveform was applied to the rod sets 120, 140 during these simulations. The simulations were performed using SIMION simulation software marketed by Scientific Instrument Services, Inc. of N.J., U.S.A.

With specific reference to FIG. 2A, the plot indicates the equipotential surfaces generated by the RF trapping potentials applied by the rod sets 120, 140. In an interaction region 130, the RF fields generated by the rod sets 120, 140 are shown to interact to generate fringing fields 132, as indicated by the curved equipotential surfaces in the interaction region 130. As discussed above, these fringing fields 132 can couple the axial and radial components of an ion's motion. Whereas fringing fields having a decreasing field strength can be used to extract resonantly-excited ions (e.g., mass selective axial ejection), the increasing field strength of the "reversed" fringing field experienced by ions traversing the first rod set 120 from left to right as shown in FIG. 2 can be effective to repel resonantly-excited ions, as discussed otherwise herein.

The effect on ion movement of the RF fields of FIG. 2A is demonstrated in the simulations of FIGS. 2B and 2C. The axial ejection of an ion from the rod set 120 (i.e., axial transmission of an ion from the rod set 120 to the rod set 140) was tested at various initial displacements of the ion from the central axis. Though identical cations (m/z 500) entered the input orifice 120*a* of the rod set 120 with identical energies (3 eV), FIG. 2B demonstrates that 100 percent of ions 102*b* having an initial displacement of $r_{init}$=0.2 mm were ejected into the rod set 140, while FIG. 2C indicates that 100 percent of ions 102*c* having an initial displacement $r_{init}$=2.0 mm were prevented from entering the rod set 140 (e.g., trapped in the rod set 120). That is, only the ions 102*b* having a relatively small displacement from the central axis could travel though the interaction region 130, while the "reversed fringing field" generated by the interaction of the RF fields of the tandem rod sets 120, 140 was effective to repulse ions 102*c* having a relatively large radial displacement.

In light of the effect of the "reversed" fringing field on ions of different radial displacement demonstrated in FIGS. 2B and 2C, the rod sets 120, 140 can be configured to isolate ions having a selected m/z by energizing ions within the rod set 120. By way of example, an auxiliary AC signal having a frequency substantially corresponding to the secular frequency of a selected m/z, for example, can be applied to the first rod set 120 so as to resonantly excite the selected ions, thereby increasing their radial oscillation amplitude within the rod set 120 relative to ions not having the selected m/z. As a result, the "reversed" fringing field can be effective to repulse the resonantly excited ions (e.g., trap the ions having a large radial oscillation amplitude within the rod set 120), while non-resonantly excited ions having smaller radial oscillation amplitudes (e.g., ions traveling on or near the axis) remain largely unaffected by the "reversed" fringing fields and can be ejected from the rod set 120 (i.e., transmitted into the rod set 140).

As will be appreciated by a person skilled in the art, the above-described exemplary ion extraction system can be utilized in various known mass spectrometer systems modified in accord with the applicant's teachings. For example, with reference now to FIG. 3, an exemplary mass spectrometer system 10 which incorporates various aspects of the applicant's present teachings is depicted.

Figure 3:
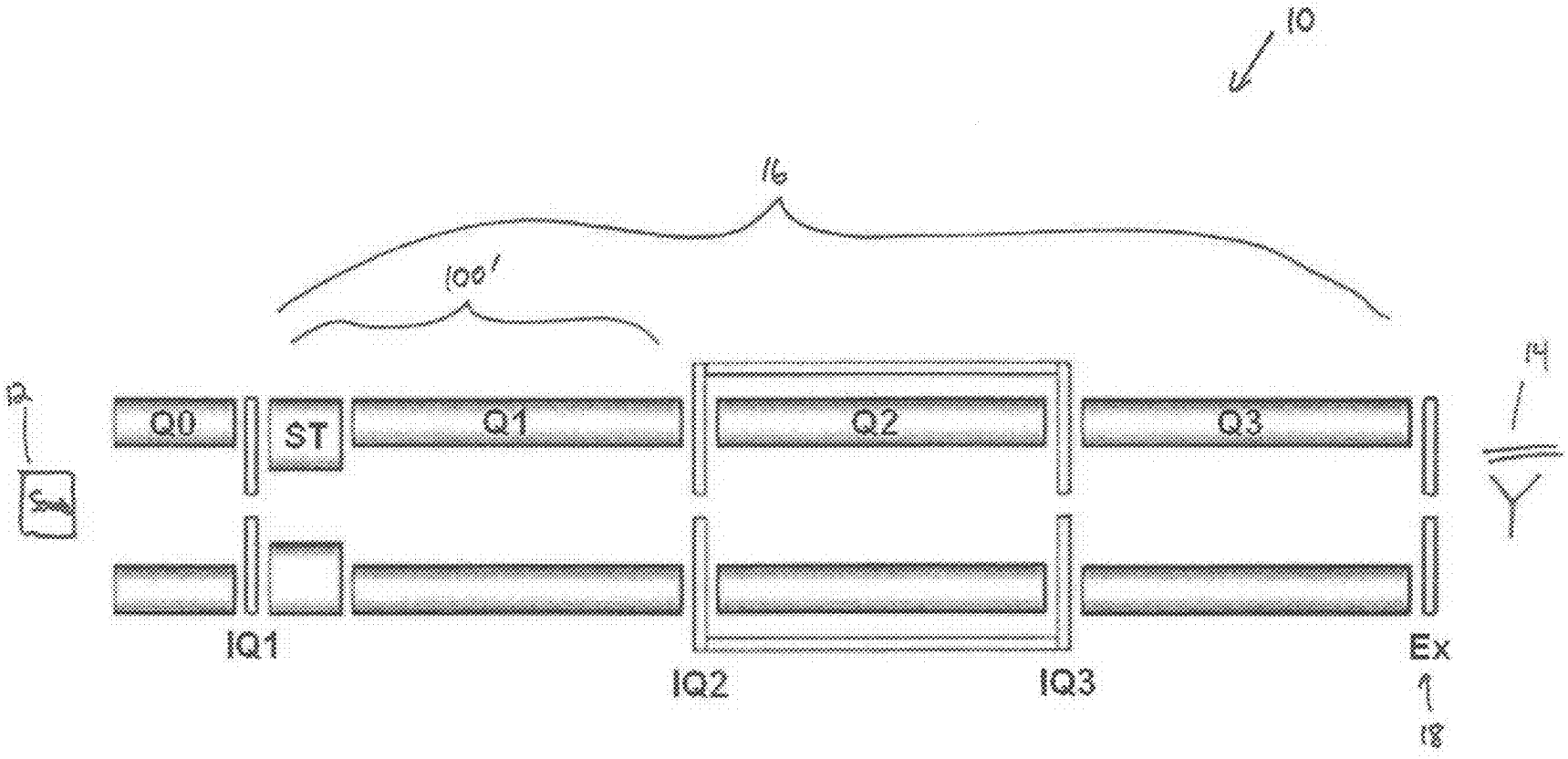
FIG. 3, in a schematic diagram, illustrates a QTRAP Q-q-Q linear ion trap mass spectrometer system comprising an ion extraction system in accordance with one aspect of various embodiments of the applicant's teachings.

In the exemplary embodiment depicted in FIG. 3, the mass spectrometer system can comprise a QTRAP Q-q-Q linear ion trap mass spectrometer system 10, as generally described by Hager and LeBlanc in Rapid Communications of Mass Spectrometry 2003, 17, 1056-1064 and modified in accord with the teachings herein. The mass spectrometer system 10 can include, for example, an ion source 12, a detector 14, and a mass analysis section 16 located therebetween. The ion source 12 can be virtually any ion source known in the art. By way of example, the ion source can be a continuous ion source, a pulsed ion source, an atmospheric pressure chemical ionization (APCI) source, an electrospray ionization (ESI) source, an inductively coupled plasma (ICP) ion source, a matrix-assisted laser desorption/ionization (MALDI) ion source, a glow discharge ion source, an electron impact ion source, a chemical ionization source, or a pho-ionization ion source, among others. Likewise, the detector 14 can be virtually any detector known in the art.

As will be appreciated by a person skilled in the art, the mass analysis section 16 can include one or more mass analyzers for separating the ions by their masses and/or performing further reactions (e.g., fragmentation of the ions generated by the sample source). By way of non-limiting example, an exemplary mass analysis section 16 can comprise, four quadrupole mass analyzers: Q0, Q1, Q2, and Q3, as shown in FIG. 3. While any one of the quadrupole rod sets can be modified in light of various aspects of the applicant's teachings, in the exemplary embodiment depicted in FIG. 3, an additional quadrupole rod set ST is positioned directly upstream and in tandem with Q1, the combination of which is herein referred to as ST+Q1 100'. Though the rod sets Q0, ST, Q1, Q2, and Q3 are generally referred to herein for convenience as quadrupoles (that is, they have four rods), they can have any other suitable multipole configurations, for example, hexapoles, octapoles, etc.

The various rod sets Q0, ST+Q1 100', Q2, and Q3 can be disposed in adjacent chambers that are separated, for example, by aperture lenses IQ1, IQ2, and IQ3, and are evacuated to sub-atmospheric pressures as is known in the art. An exit lens 18 can be positioned between Q3 and the detector 14 to control ion flow into the detector 14. As will be appreciated be a person skilled in the art, the various components of the mass spectrometer system 10 can be coupled with a controller (not shown) and one or more power supplies (not shown) to receive AC, RF, and/or DC voltages selected to configure the quadrupole rod sets for various different modes of operation depending on the particular MS application. By way of example, ions can be trapped radially in any of Q0, ST+Q1 100', Q2, and Q3 by RF voltages applied to the rod sets, and axially through the application of various AC, RF, and/or DC voltages applied to various components of the mass spectrometer.

During operation of the mass spectrometer 10, ions generated by the ion source 12 can be extracted into a coherent ion beam by passing successively through apertures in an orifice plate and a skimming plate (not shown) to result in a narrow and highly focused ion beam. The ion beam can then enter Q0, which can be operated as a collision focusing ion guide, for instance by collisionally cooling ions located therein. In various embodiments, Q0 can be operated as a conventional transmission RF/DC quadrupole mass filter that can be operated to select an ion of interest and/or a range of ions of interest (e.g. a passband filter).

After passing through Q0, the ions entering ST+Q1 100' can be subject to a high-resolution extraction step in accord with various aspects of applicant's teachings. By way of example, fringing fields resulting from the interaction between RF fields generated in ST and Q1 can be effective to separate ions having small radial oscillation amplitudes from those having relatively large radial oscillation amplitude, as discussed above in reference to FIGS. 1 and 2A-2C. It should be appreciated that in the exemplary embodiment depicted in FIG. 3, the orientation of the quadrupole rod sets ST, Q1 is reversed relative to the ion extraction device 100 discussed above. That is, in the schematic depicted in FIG. 3, the rod set ST can exhibit a higher q value relative to that of Q1 for any m/z (e.g., the distance between the rods of the rod set ST is less than the distance between the rods of the rod set Q1). As will be discussed in detail below, ST+Q1 100' can enable trapping and/or extraction of resonantly-excited target ions for further downstream processing.

By way of example, with continued reference to FIG. 3, the target ions can be transmitted from ST+Q1 100' into Q2, which as shown can be disposed in a pressurized compartment and can be configured to operate as a collision cell. A suitable collision gas (e.g., argon, nitrogen, helium, etc.) can be provided by way of a gas inlet (not shown) to fragment and/or thermalize ions in the ion beam. Within Q2, the target ions can be subject to various processes including, for example, collision induced dissociation and/or ion-ion reactions, though other modes of operation of Q2 can be utilized (e.g., in RF-only ion transmission mode). The precursor target ions and/or product ions can be transmitted by Q2 into the adjacent quadrupole rod set Q3, which can be operated in a number of manners, for example as a scanning RF/DC quadrupole, a quadrupole ion trap, or as a linear ion trap. By way of non-limiting example, ions trapped in Q3 can be mass-selectively scanned to the detector 14 through the exit lens EX via mass selective axial ejection (MSAE), as described in detail in U.S. Pat. No. 6,177,668, entitled "Axial Ejection in a Multipole Mass Spectrometer," which is hereby incorporated by reference in its entirety.

Figure 4:
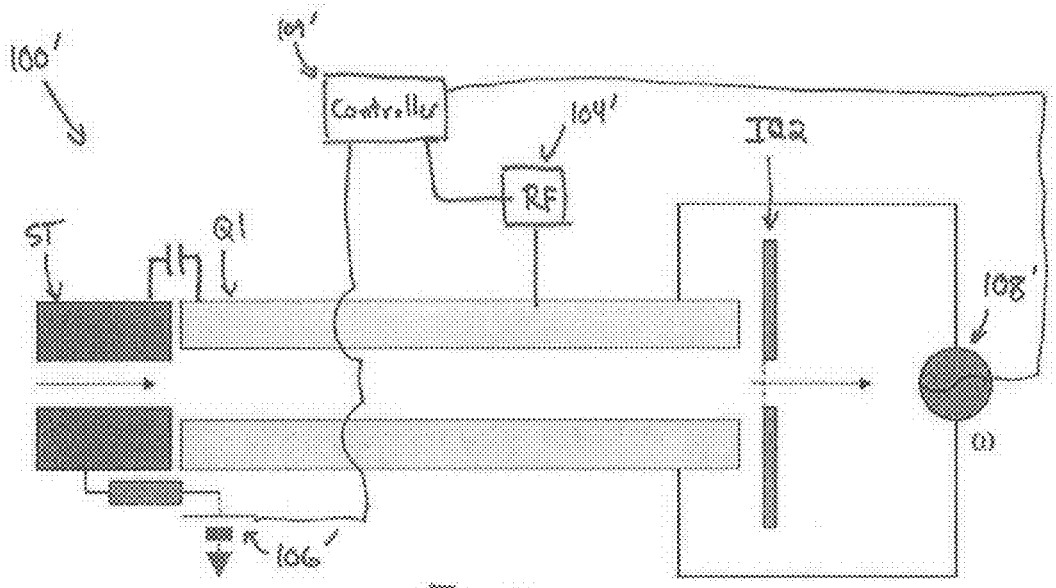
FIG. 4, in schematic diagram, depicts various aspects of the ion extraction system of FIG. 3.

With reference now to FIG. 4, a schematic of the ion extraction system ST+Q1 100' is depicted in more detail, with the ions being introduced into ST from the left (e.g., from Q0 in the mass spectrometer system 10 depicted in FIG. 3). As depicted in FIG. 4, the rod sets ST+Q1 can be positioned in tandem. An exit lens IQ2 is disposed adjacent to the downstream end of the rod set Q1. An RF voltage source 104' can be configured to apply an RF potential to Q1, which can be capacitively coupled to ST, so as to radially confine the ions within ST, Q1. As discussed above, the RF radial confinement fields of the rod sets ST, Q1 can differ relative to one another such that their interaction can generate a fringing field. In various embodiments, the different RF fields in the rod sets ST, Q1 can be characterized, for example, by a non-unitary ratio of $q_{ST}$ to $q_{Q1}$. By way of example, the ratio of $q_{ST}$ to $q_{Q1}$ can be greater than one (i.e., the rod set ST can have a greater q value than the rod set Q1). In various exemplary embodiments, the ratio of $q_{ST}$ to $q_{Q1}$ can be in the range of from about 1.1 to about 1.3. In an exemplary embodiment, as depicted in FIG. 4, the RF potential applied to the rod sets ST, Q1 is identical, with the q value of ST being increased relative to Q1 by decreasing the distance between the rods in the rod set ST.

It should be noted that the ratio of the q values appears inverted relative to that discussed above with reference to FIGS. 1 and 2A-2C based on the convention used herein that the numerator corresponds to the rod set in which the ions initially entered the ion extraction systems 100 and ST+Q1 100'.

As shown in FIG. 4, the rod set Q1 can additionally be coupled to an auxiliary AC source 108' to generate an auxiliary AC field within the rod set Q1. The rod set ST can be coupled to a DC power source 106' that can maintain the rod set ST at a bias DC potential relative to Q1. A controller 109' can be coupled to the various components to control, for example, the application of RF, AC, and DC voltages to ST, Q1, and IQ2.

Figure 5A:
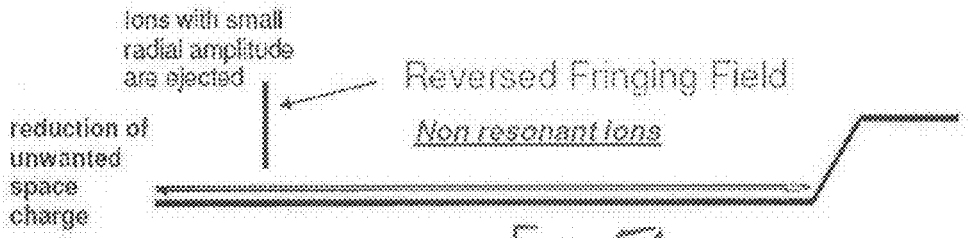
FIG. 5A, in schematic diagram, depicts the ejection of non-resonant ions in accord with various aspects of the ion extraction system of FIG. 4.
Figure 5B:
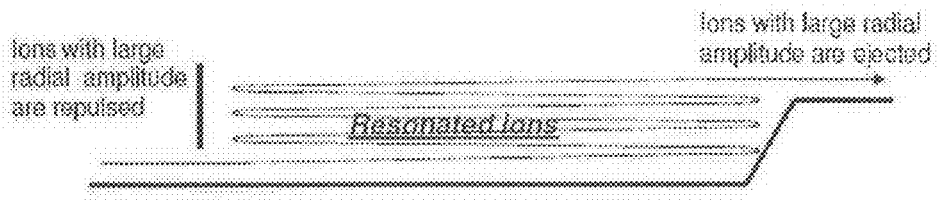
FIG. 5B, in schematic diagram, depicts the resonant excitation of a target ion in accord with various aspects of the ion extraction system of FIG. 4.

In use, as depicted in the schematics of FIGS. 5A and 5B, ions can be introduced into ST from the upstream end, with ST operating in RF-only transmission mode such that ions can be transmitted into Q1 towards IQ2 (i.e., from left to right). As will be appreciated by a person skilled in the art, a barrier potential can be applied to IQ2 such that at least a portion of the ions traversing Q1 are repulsed (e.g., reflected) by IQ2 back toward ST. Energizing the ions within Q1, for example, via an auxiliary AC signal applied to the rods of Q1 can be effective to resonantly excite target ions of a selected m/z as otherwise discussed herein such that the radial oscillation amplitude of the target ions can be increased. It will be appreciated by a person skilled in the art that the auxiliary AC waveform can be applied to Q1 to generate a dipolar or quadrupolar excitation field. Moreover, in various embodiments, the auxiliary AC waveform can be applied continuously to Q1 such that target ions can be excited before and/or after being repulsed by IQ2.

With specific reference now to FIG. 5A, ions traversing Q1 towards ST that are not resonantly excited can be ejected from Q1 (e.g., transmitted into ST). That is, the ions that are not sufficiently excited by the auxiliary AC signal and remain substantially confined to the axis of ST+Q1 100' can overcome the DC barrier provided by the DC bias on ST, thereby eliminating undesired ions and any space charge effect associated therewith.

As depicted in FIG. 5B, the resonantly excited target ions can be repulsed by the "reversed" fringing field towards IQ2, as otherwise discussed herein. As will be appreciated by a person skilled in the art, the target ions trapped within Q1 can then be transmitted out of the trap by lowering the barrier potential of IQ2. In various embodiments, however, the IQ2 barrier potential can be maintained and the target ions can continue to gain energy from the auxiliary AC signal as they are serially reflected between the "reversed" fringing field and IQ2, as schematically depicted in FIG. 5B. By way of example, the reflections can continue until the resonant excitation of the target ions results in the target ions obtaining enough radial energy to overcome the exit barrier of IQ2, for example, through the coupling of the target ions' radial motion and axial motion in an extractive fringing field in an extraction region of Q1 adjacent to IQ2 as described for example in U.S. Pat. No. 6,177,668, entitled "Axial Ejection in a Multipole Mass Spectrometer," which is hereby incorporated by reference in its entirety.

Unlike prior target ion isolation techniques, the increased duration of the target ions' exposure to the auxiliary AC signal due to the multiple reflections (and in some cases, a decreased amplitude of the excitation signal) can improve the target ions' divergence from substantially isobaric ions, thereby generating a more selective isolation and increased resolution. Moreover, this quasi-trapping approach can improve the resolution of isolation by (1) automatically ejecting undesired ions, thereby reducing the space charge effect, (2) continuously extracting target ions from Q1 for downstream storage or analysis, thereby reducing "self" space charge, and (3) allowing for the continuous injection and ejection of target ions, thereby improving the duty cycle of isolation.

A person skilled in the art will appreciate that although the tandem quadrupoles are depicted in conjunction with Q1, the applicant's teachings herein can be applied to various other multipole ion traps in the exemplary mass spectrometer systems described herein and as otherwise known in the art.

Figure 6:
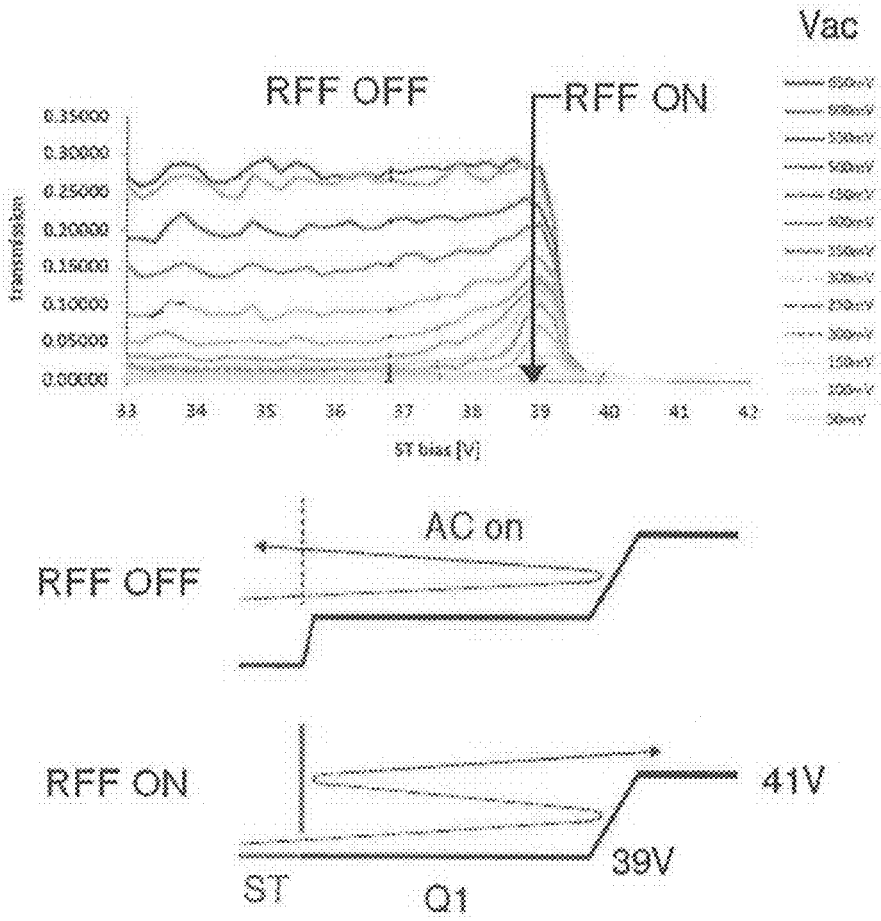
FIG. 6 depicts data and a corresponding schematic diagram demonstrating the selective application of a "reversed" fringing field in accordance with one aspect of various embodiments of the applicant's teachings.

In various embodiments, the "reversed" fringing field discussed above in accordance with various aspects of applicant's teaching can be selectively applied by adjusting the DC potential between ST and Q1, for example. With reference now to FIG. 6, the plot depicts the efficiency of ion transmission from Q1 to ST and demonstrates that the "reversed" fringing field can be turned off by maintaining the DC voltage of ST at an attractive potential relative to that of Q1. Specifically, FIG. 6 demonstrates that as the DC bias voltage applied to ST is scanned from 33 V to about 39 V (while maintaining Q1 at a DC voltage of 39 V and IQ2 at a DC voltage of 41 V), ions excited in Q1 by varying amplitudes of an auxiliary excitation signal can be transmitted from Q1 to ST, indicating that there is no fringing field interfering with the movement of the ions. However, when a voltage of about 39 V is applied to ST such that there is no DC potential between ST and Q1, the transmission efficiency of the ions into ST from Q1 quickly drops. This indicates that a "reversed" fringing field has been generated that is effective to repel the radially excited ions and prevent their transmission into ST from Q1.

Figure 7:
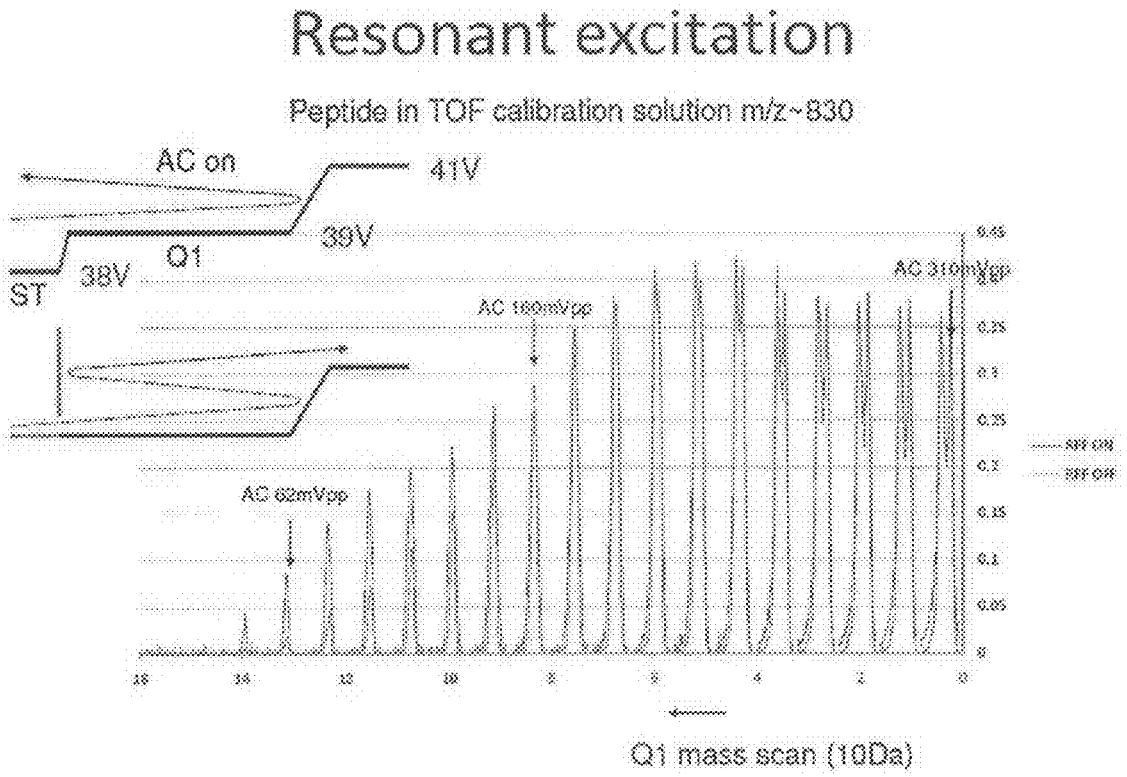
FIG. 7 depicts data and a corresponding schematic diagram demonstrating an improvement in ion transmission at low excitation amplitudes with the use of a "reversed" fringing field in accordance with one aspect of various embodiments of the applicant's teachings.

With reference now to FIG. 7, the data demonstrates an improvement in the transmission of ions in the presence of a reversed fringing field generated in accord with various aspects of applicant's teachings. As discussed otherwise herein, the increased excitation duration provided by a reversed fringing field can enable the application of auxiliary AC excitation signals of decreased amplitude. FIG. 7 demonstrates that the transmission of a peptide having an m/z of about 830 in a TOF calibration solution in a system in the presence of a reversed fringing field can provide substantially identical results to that of a system with the reversed fringing field off for auxiliary excitation amplitudes in a range from about 310 $mV_{p-p}$ to about 160 $mV_{p-p}$. However, use of the reversed fringing field provides improved transmission for excitation amplitudes less than about 160 $mV_{p-p}$ to about 62 $mV_{p-p}$, as demonstrated in the difference between the peaks on the left side of the plot at each excitation amplitude. Applicant further notes that for the higher excitation amplitudes, the presence of the split peaks demonstrates that the target ions are overly excited, and are fragmented following collisions with a neutral gas. This unintended dissociation can be inhibited, for example, by performing auxiliary AC excitation with a higher amplitude in the presence of a neutral buffer gas lighter than nitrogen gas ($N_2$). By way of example, the use of helium can inhibit collision induced fragmentation in high amplitude auxiliary excitations.

Figures 8A, 8B:
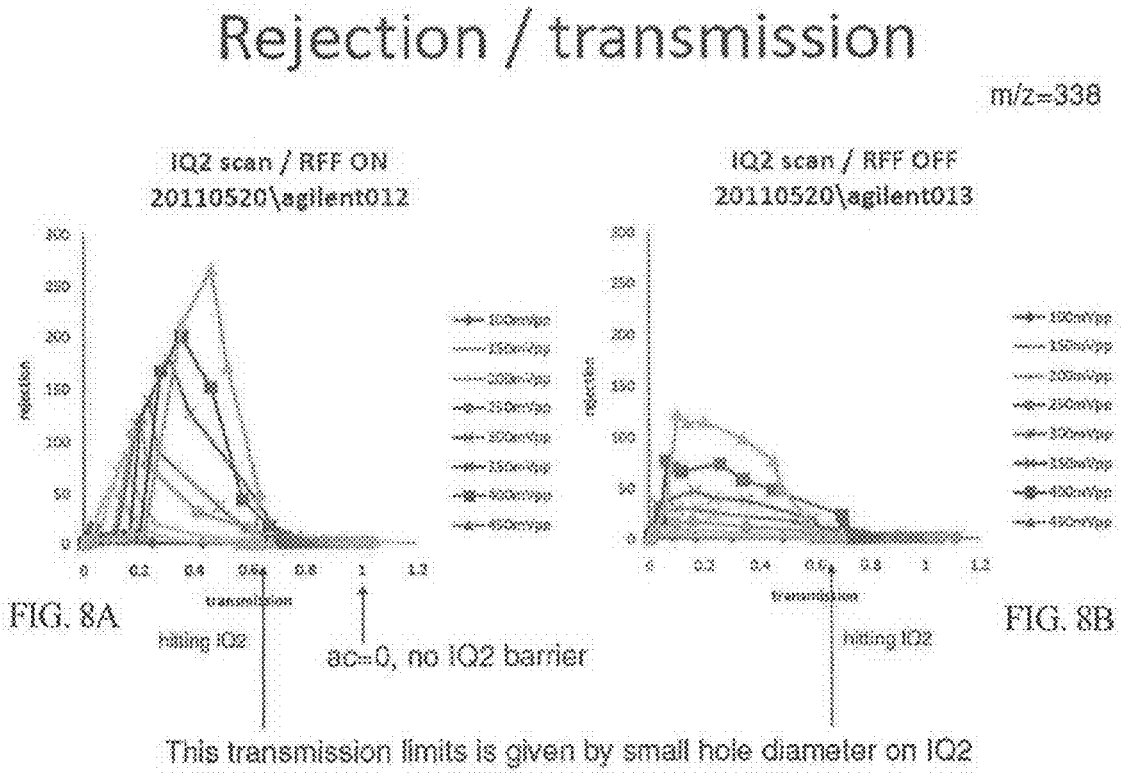
FIG. 8A depicts data demonstrating the isolation of ions with m/z=338 in accordance with one aspect of various embodiments of the applicants' teachings.
FIG. 8B depicts data demonstrating a conventional isolation technique for ions with m/z=338.

With reference now to FIGS. 8A and 8B, data is presented demonstrating the improvements in transmission of an ion having an m/z of 338 when axially excited in the presence and absence, respectively, of the reversed fringing field. The data demonstrates isolation of ions with m/z=338. In this exemplary experiment, the IQ2 bias was scanned with a fixed auxiliary AC waveform being applied to the rods of Q1. The horizontal scale depicts transmission (i.e., a ratio of the transmitted ions to the total number of ions) when the ions are excited by the auxiliary AC signal. The vertical scale depicts rejection (i.e., a ratio of total ions to the transmitted ions) when the ions are not excited by the auxiliary AC signal. FIG. 8A, which depicts the isolation of ions using a reversed fringing field in accordance with various aspects of applicant's teachings, demonstrates improved resolution compared to the isolation of ions. Further, the data demonstrates a limit of transmission of about ~60%. While not being bound by any particular theory, the applicant believes that transmission is limited by the size of the hole in the exit electrode IQ2. Improvements in transmission would therefore be expected with the use of an exit electrode having a larger aperture.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. A method for processing ions in a multipole ion trap, comprising:

introducing ions into a first multipole rod set positioned in tandem with a second multipole rod set, each rod set having a first end and a second end, the ions being introduced into the first and second rod sets through said first end of said first rod set;

generating RF fields within the first and second rod sets so as to radially confine the ions, said RF fields within the first and second rod sets interacting in an interaction region between the second end of the first rod set and the first end of the second rod set to produce a fringing field;

generating a barrier field at the second end of said second rod set so as to repel at least a portion of said ions away from the second end of the second rod set and toward the first rod set; and energizing said repelled ions within said second rod set so that at least a portion of said energized ions are repulsed by the fringing field back toward the second end of the second rod set.

2. The method of claim 1, wherein at least a portion of said repelled ions are ejected into said first rod set.

3. The method of claim 2, wherein at least a portion of said energized ions are ejected into said first rod set.

4. The method of claim 1, wherein energizing said repelled ions comprises applying an auxiliary excitation signal to said second rod set so as to resonantly excite ions having a selected m/z, wherein the auxiliary excitation signal comprises an auxiliary AC waveform having a frequency that substantially matches a secular frequency of said ions having said selected m/z, wherein the auxiliary AC waveform generates a dipolar excitation field, and wherein said ions having the selected m/z are repulsed by the fringing field.

5. The method of claim 4, wherein said RF field within said second rod set interacts with said barrier field in an extraction region adjacent to the second end of the second rod set to produce a second fringing field, and wherein said auxiliary AC waveform selectively ejects at least a portion of said ions having said selected m/z from the second end of the second rod set, and wherein said barrier field is a DC field.

6. The method of claim 1, wherein generating the RF fields within the first and second rod sets comprises applying an identical RF waveform to each of the first and second rod sets, wherein said first and second rod sets are axially aligned along a central axis, wherein a distance between the central axis and rods of the first rod set is less than a distance between the central axis and rods of the second rod set.

7. The method of claim 1, wherein generating the RF fields within the first and second rod sets comprises applying a first RF waveform to the first rod set and a second RF waveform to the second set, wherein the first and second RF waveforms are different, wherein the first RF waveform has a larger amplitude than the second RF waveform, and wherein the first and second multipole rod sets comprise first and second quadrupole rod sets.

8. The method of claim 1, wherein, for an ion having a selected m/z, a q value for the first rod set is greater than a q value for the second rod set.

9. The method of claim 8, wherein a ratio of the q value of the first rod set to the q value of the second rod set is in a range of from about 1.1 to about 1.3.

10. The method of claim 1, further comprising generating a DC potential between said first and second rod sets, and further comprising adjusting said DC potential to modulate the fringing field.

11. A method for processing ions in a multipole ion trap, comprising:

generating RF radial confinement fields within a first and second multipole rod set positioned in tandem, a ratio of q value exhibited by the second rod set relative to the first rod set being greater than one for any m/z, said RF axial confinement fields within the first and second rod sets interacting in an interaction region between the first and second rod sets so as to produce a fringing field;

transmitting ions through said first rod set towards said second rod set; and increasing the radial oscillation amplitude of at least a portion of the ions within said first rod set such that at least a portion of said ions having an increased radial oscillation amplitude are repulsed by said fringing field.

12. The method of claim 11, wherein at least a portion of ions transmitted through said first rod set are axially ejected into said second rod set during said excitation of said excited ions.

13. The method of claim 11, wherein the ratio of q value is in a range of about 1.1 to about 1.3.

14. The method of claim 11, wherein increasing the radial oscillation amplitude comprises resonantly exciting at least a portion of the ions within the first rod set, and wherein resonantly exciting at least a portion of the ions within the first rod set comprises applying an auxiliary excitation signal to the first rod set, the auxiliary excitation signal comprising an auxiliary AC waveform having a frequency that substantially matches a secular frequency of ions having a selected m/z.

15. A mass spectrometer system, comprising:

an ion source a first multipole rod set extending between a first end and a second end, said first end for admitting ions from the ion source;

a second multipole rod set extending between a first end and a second end, a ratio of q value exhibited by the first rod set relative to the second rod set being greater than one for any m/z;

a controller coupled to the first and second rod sets and configured to (i) apply an RF waveform to at least one of the first and second rod sets so as to produce an RF axial confinement field in each of the first and second rod sets, wherein said RF axial confinement fields interact in an interaction region between the first and second rod sets to produce a fringing field; (ii) generate a barrier field at the second end of the second rod set; (iii) generate a DC potential between the first and second rod sets; and (iv) apply an auxiliary AC waveform to the second rod set, whereby the auxiliary AC waveform energizes ions repelled from the barrier field so that at least a portion of said energized ions are repulsed by the fringing field back toward the second end of the second rod set; and a detector for detecting ions ejected from the second end of the second rod set.

16. The system of claim 15, wherein at least a portion of said energized ions are ejected into said first rod set.

17. The system of claim 15, wherein the auxiliary excitation signal comprises an auxiliary AC waveform having a frequency that substantially matches a secular frequency of ions having a selected m/z, wherein the auxiliary AC waveform generates a dipolar excitation field, wherein said RF axial confinement field within said second rod set interacts with said barrier field in an extraction region adjacent to the second end of the second rod set so as to produce a second fringing field, and wherein said auxiliary AC waveform is configured to selectively eject at least a portion of said ions having the selected m/z from the second end of the second rod set, and wherein said ions having the selected m/z are repulsed by the fringing field.

18. The system of claim 15, wherein the controller is configured to apply an identical RF waveform to each of the first and second rod sets so as to produce an RF axial confinement field in each of the first and second rod sets, wherein said first and second rod sets are axially aligned along a central axis, and wherein a distance between the central axis and rods of the first rod set is less than a distance between the central axis and rods of the second rod set.

19. The system of claim 15, wherein the controller is configured to apply a first RF waveform to the first rod set to produce an RF axial confinement field in the first rod set and a different second RF waveform to the second rod set, wherein the first RF waveform has a larger amplitude than the second RF waveform, and wherein the controller is configured to adjust said DC potential so as to modulate the fringing field.

20. The system of claim 15, wherein a ratio of the q value of the first rod set to the q value of the second rod set is in a range of from about 1.1 to about 1.3.

* * * * *